United States Patent [19]

Engel

[11] Patent Number: 4,941,412

[45] Date of Patent: Jul. 17, 1990

[54] MODULAR WORKING TABLE

[75] Inventor: Hartmut S. Engel, Freiberg am Neckar, Fed. Rep. of Germany

[73] Assignee: Ernst Fischer GmbH & Co., Freudenstadt, Fed. Rep. of Germany

[21] Appl. No.: 231,754

[22] Filed: Aug. 12, 1988

[30] Foreign Application Priority Data

Aug. 14, 1987 [DE] Fed. Rep. of Germany ..... 3727193

[51] Int. Cl.[5] ..... A47B 3/06

[52] U.S. Cl. ..... 108/156; 108/157; 108/106; 108/111

[58] Field of Search ..... 108/156, 157, 153, 154, 108/111, 106, 107, 50, 110, 144, 114; 403/172, 176; 248/188.1; 211/187, 140, 201

[56] References Cited

U.S. PATENT DOCUMENTS

| | | | |
|---|---|---|---|
| 1,765,643 | 6/1930 | Allibone et al. | 108/23 |
| 1,963,477 | 6/1934 | Stein | 108/23 X |
| 3,056,507 | 10/1962 | Squiros, Jr. et al. | 108/106 |
| 4,163,537 | 8/1979 | Mourgue | 108/156 X |
| 4,413,570 | 11/1983 | Haigh | 108/156 X |
| 4,621,938 | 11/1986 | Weilow | 403/172 X |
| 4,637,324 | 1/1987 | Janson | 108/111 |
| 4,705,327 | 11/1987 | Bollman | 108/144 X |

FOREIGN PATENT DOCUMENTS

| | | |
|---|---|---|
| 8629967 | 12/1986 | Fed. Rep. of Germany . |
| 8705613 | 6/1987 | Fed. Rep. of Germany . |
| 2238451 | 7/1974 | France . |

*Primary Examiner*—Jose V. Chen

*Attorney, Agent, or Firm*—Townsend and Townsend

[57] ABSTRACT

A working table is described in which the rear support elements are formed as hollow sectional parts in order to achieve the highest possible degree of variability in the provision of working levels and storage levels. Coupling elements which are secured to the surfaces or to transverse support elements are connectable to the hollow sectional parts in shape-fitted and force-locked manner.

15 Claims, 4 Drawing Sheets

MODULAR WORKING TABLE

Figure 1:
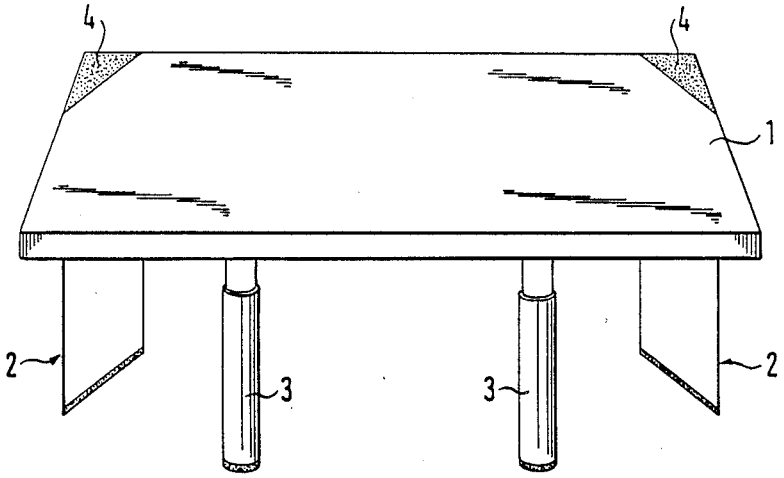

The invention relates to a working table, in particular for office, laboratory and workshop use, comprising a working surface supported by means of two rear and front support elements.

Known working tables of this kind leave much to be desired with regard to clear layout, to the variability of the layout, to the combinability of the layout and to the ability to comprehend and design more complex assemblies.

The object underlying the invention is to provide a working table of the initially named kind which, starting from a transparent and stable basic shape, can be built out and enlarged without problem, while simultaneously integrating the technical services that are required, which can in particular be enlarged with storage or support surfaces for displays and/or blocks of instrumentation which do not make the actual working surface smaller, and which can be supplemented by fixed or movable containers. Moreover, such working tables should be suited to being arranged with like tables in rows and in various other combinations.

This object is satisfied in accordance with the invention essentially in that at least the rear support elements each comprise a hollow section having at least two integral coupling flanges with mounting openings formed thereon, which extend over at least a part of the hollow section and which in particular subtend a right angle to one another; and in that coupling elements which are complementary in shape to the coupling flanges are secured to the working surface and can be screwed to the coupling flanges in form and force-locked manner.

The hollow sectional supports at the rear, which are of stable shape and consist of extruded parts, provide, in conjunction with the form and force locked coupling elements which are provided on the working surface, a stable basic structure which can be supported in the front region by simply constructed supports, for example consisting of cylindrical elements, or of fixedly attached laterally disposed containers.

The hollow sectional parts forming the support elements preferably consist of a tubular central part and coupling channels and coupling flanges which are formed thereon and displaced around the outer periphery, with the coupling channels and coupling flanges extending over the length of the hollow sectional part.

In this manner it is possible to achieve, via the coupling flanges, a stable connection with the coupling elements connected to the working surface. It is also possible to achieve a variable connection via the coupling channels for like support elements of adjoining working tables or of intermediate elements, so that stable and simultaneously esthetically shaped rows and other combinations can be obtained depending on the field of use.

Furthermore, it is important for the subject of the invention that a plane cover section plate can be fixed between the coupling flanges and that an angled cover section can be fixed in each case between one coupling flange and a projection of a coupling channel, with these cover sections forming an equilateral or a right-angled triangle in cross-section, together with the outer contour of the central part.

This layout leads not only to an ideal aesthetic appearance of the working table but also leads to the provision of cable guiding channels out of which the electrical lines can be guided in practically invisible manner into horizontally extending cable channels, cable shafts and the like. Indeed, on arranging such working tables in series, these cables can also be laid in the form of through-loops.

In accordance with a further advantageous layout of the invention the open end of the tubular central part is formed as a plug and bearing mount for support elements, for example for display screens, communication apparatus and the like, or also for illumination arrangements. In this manner very stable arrangements are obtained which, on the one hand, do not impair the working surface but on the other hand, substantially increase the range of uses of the working table.

The special advantages of the basic concept of the working table of the invention are particularly notable when the hollow sectional supports associated with the rear corner regions of the working surface extend beyond the working surface and form, in the projecting region, with their coupling flanges, attachment mounts for shelves, apparatus supports, transverse racking, transverse covered arrangements and the like which are equipped with coupling elements of the kind used for the working surface.

Thus, with no change in principle of the basic construction one can produce at least one exceptionally stable additional level which offers the most diverse accommodation possibilities, which can contain electrical connection and illumination units, and which again does not impair the useful working surface of the table. As a result of the variable connection possibilities to the rear hollow sectional supports which exist, the height of the desired additional level can in each case be chosen as best suits the particular application.

It is of advantage for the stability and freedom from oscillation of working tables having more than one plane if a rigid rod is arranged between each of the front support elements and the lower side of the working surface at its rear region.

Further advantageous developments of the invention are set forth in the subordinate claims.

Figure 2:
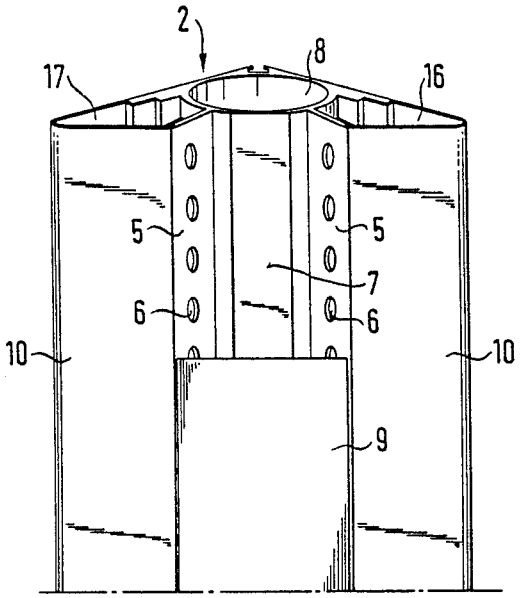
Figure 3:
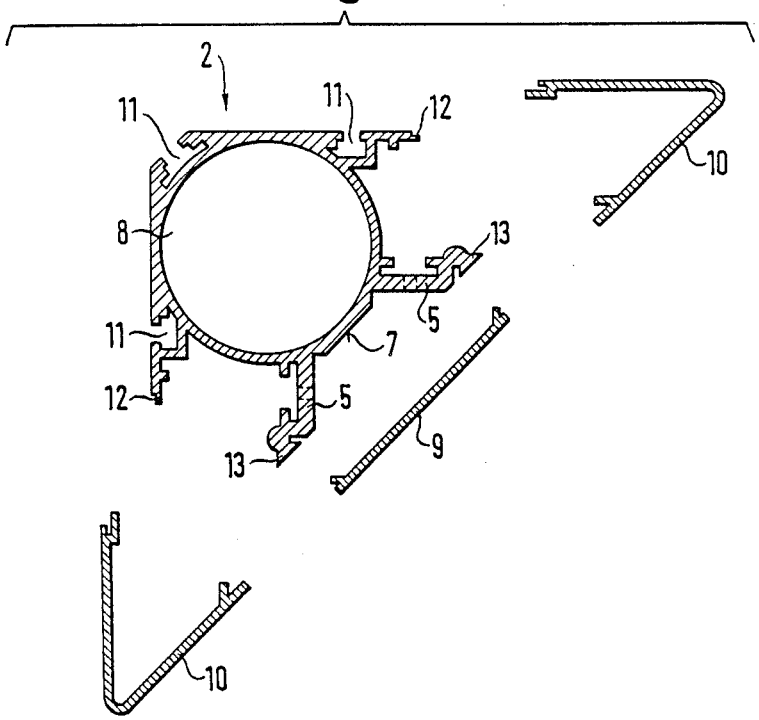
Figure 4:
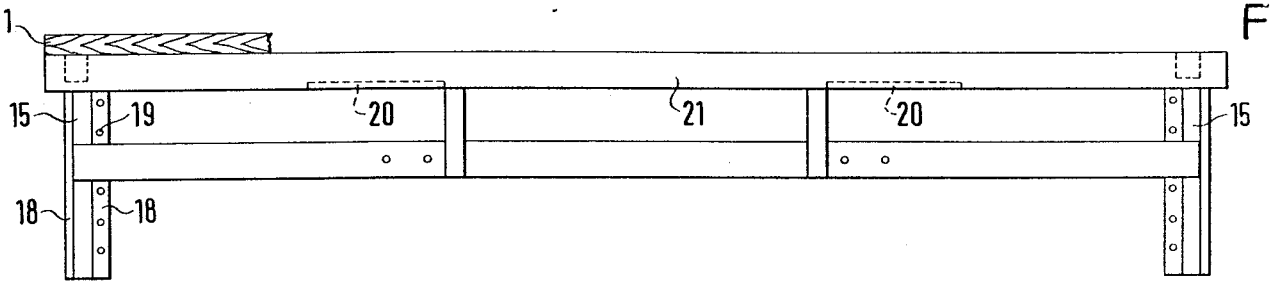
Figure 5:
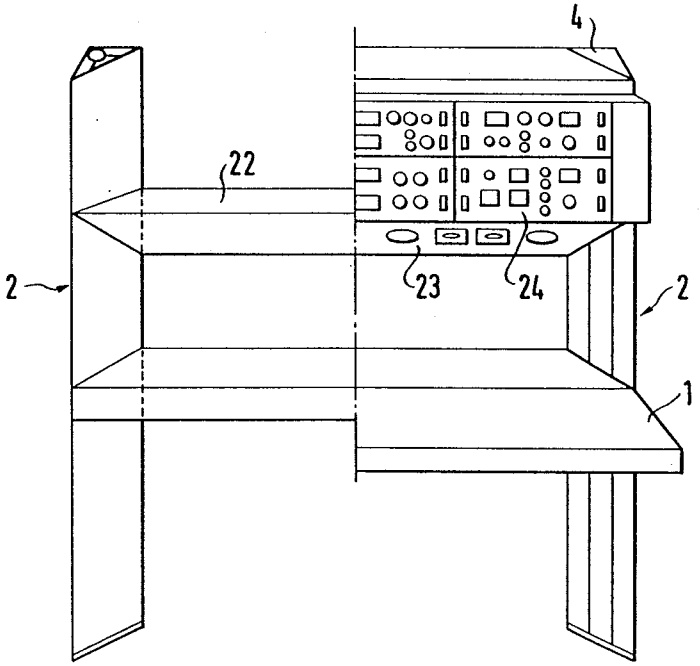
Figure 6:
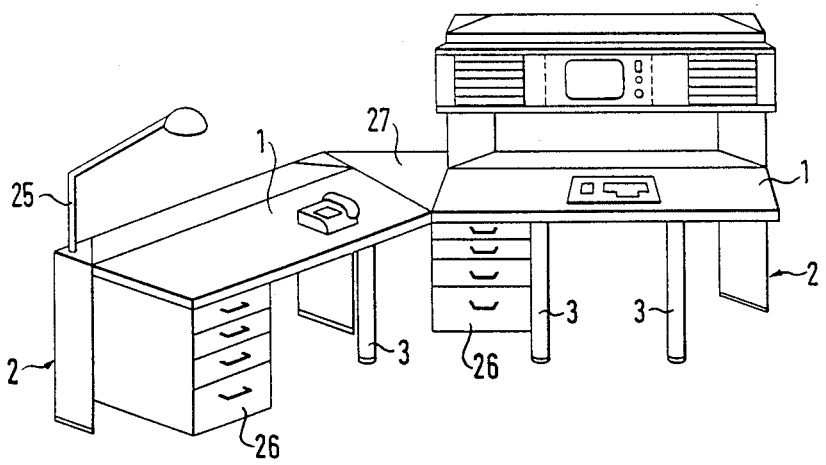
Figure 7:
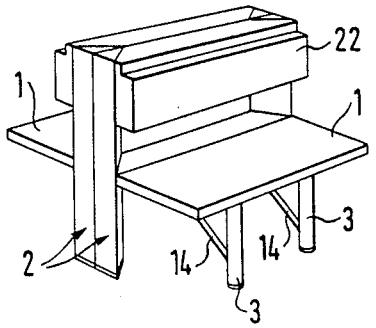

The invention will now be explained in more detail in the following with reference to embodiments and to the drawing in which are shown:

FIG. 1 a schematic representation of a basic embodiment of a working table in accordance with the invention, FIG. 2 a perspective partial illustration of a support element provided in the rear corner region of the table of FIG. 1, FIG. 3 a schematic cross-sectional representation of the support element of FIG. 2, FIG. 4 a schematic representation of a support frame for the working surface, the support frame being provided with coupling elements, FIG. 5 a schematic partial illustration of a multi-level embodiment of a working table in accordance with the invention, FIG. 6 a schematic representation of a further embodiment of the subject of the invention in combined form, and FIG. 7 a double table arrangement which is in particular executed as a laboratory working location.

FIG. 1 shows a stably executed board or panel forming a working surface or working top 1, which is cut away at an angle at its rear corner regions, and which is connected in shape and force locked manner with hollow section support elements 2 via non-illustrated coupling elements. These hollow section support elements 2 are closed at the floor end and at the working surface end by cover parts 4 which are preferably clamped or wedged into the hollow sections. At the front side the working surface 1 is supported via two inwardly displaced cylindrically shaped support elements 3. Support element 3 may be telescopically adjustable. In this manner lateral accommodation regions are provided for containers at side regions of working surface 1.

FIG. 2 shows a perspective partial illustration of a hollow sectioned support element 2 which consists essentially of a tubular central part 8 and flange parts formed thereon in unitary or one-piece manner. Coupling flanges 5, in particular of strip-like form, are provided which extend over the length of the hollow sectional element 2, which subtend an angle of 90° to one another and are provided with rows of holes 6 serving for mounting purposes. The actual working surface can be secured via these coupling flanges 5 at the desired level, and indeed via coupling elements which cooperate in form-shaped manner with these coupling flanges and which are in turn secured to the working surface.

Cover sections can be coupled via corresponding projections to the hollow section support elements 2, and indeed a substantially planar cover section part 9 which spans over the region between the two coupling flanges 5, and angled cover sections 10 which in the installed state form, together with the planar cover plate 9 a structure for the support element 2 which is triangular in cross-section, and which in particular has the shape of a right triangle.

The chambers 16, 17 formed by the cover parts 9, 10 can simultaneously be used as cable channels or conduits.

The sectional illustration of FIG. 3 shows the relative position of the coupling flanges 5, of the abutment surface 7 disposed between them and of the coupling channels 11 which are distributed around the periphery.

The coupling channels 11, which make it possible to couple adjacent working tables or intermediate boards or surfaces, are so arranged that it is possible to achieve both a direct corner connection and also connections on both sides of this connection corner region. Projections 12 and 13 at the outwardly projecting flange parts ensure that the cover plates or angled cover sections 9, 10 can be attached and fixed via snap-in latch connections.

FIG. 4 shows in schematic manner a support frame 21 which is fixedly connected to the working surface 1. Coupling elements 15 are secured to the support frame 21 and can be screwed to the coupling flanges 5 of the hollow section support elements 2 at the height that is desired in any particular case, and thus provide a stable assembly.

The coupling elements 15 are practically complementary in shape to the accommodation region 5, 7 of the hollow section support elements 2, and thus include two mounting limbs with rows of holes 19, with the mounting limbs again subtending in an angle of approximately 90° to one another.

The frame construction 21 is provided with correspondingly disposed flange plates 20 for the mounting of the front support elements.

FIG. 5 shows a particularly advantageous variant of the invention in which the rear hollow section support elements 2 are extended upwardly beyond the working surface 1, and in which a transverse support unit 22 is connected to the hollow section support elements at a distance from the working surface 1, and indeed in the same manner as the working table via correspondingly shaped coupling elements. In this manner an additional stable level is provided which makes it possible to accommodate a plurality of racks 24 for example. This level permits good access to such racks, and makes it easy to ensure that such racks do not lead to a reduction of the available working surface 1. The cables that are required can be fed invisibly via the cable channels formed in the hollow section support elements 2 into the region of the transverse support unit, which is preferably likewise executed as a hollow sectional part, so that the electrical connection regions 23 which are required in any particular case, can be provided there or optionally so that illumination units can be mounted thereon.

FIG. 6 shows an example of a combination of a working table of the kind illustrated in FIGS. 1 and 5 using an intermediate part 27. These working tables are combined with containers 26 which can be fixedly attached or movably arranged and which are in particular flush at the sides with the working surface.

The tubular central part that is provided for the hollow sectional support element 2 forms a plug mount and bearing mount for support parts which are preferably swivellable, for example supports for communication apparatus or for monitors, or for a pivotable illumination arrangement 25 such as is schematically indicated in FIG. 6. In this manner an ideal illumination of the workplace can be achieved in a particularly space saving manner.

The example shown in FIG. 7 of the combination of two workplaces in accordance with FIG. 5 makes it clear that one can obtain an extremely stable compact arrangement by mounting two such units back to back, by coupling together the hollow section support elements 2. The rigid bars or rods 14 which can be seen in this illustration between the front support elements 3 and the lower side of the working surface 1 makes it possible, in surprisingly simple manner, to preclude any form of vibration effects in the total arrangement, and simultaneously to obtain an increase in stability.

The tubular central part 8 can be particularly advantageously used to convey pressurised air or vacuum to the particular workplace. In so doing the central part 8 can serve directly as a guide conduit for the pressurised air or can be connected with a vacuum source. It is however also possible to guide corresponding conduits or hoses within the central part 8. Coupling locations for the connection to the pressurised air or to the vacuum can be directly integrated into the support element.

As a result of the above described connection and coupling possibilities it is possible to provide the most diverse configurations of the working surfaces and thus to adapt the furniture to the shape and size of the rooms available and to the requirements set by specific working sequences, and indeed both when using working tables with only one level and also using tables with additional support levels.

We claim:

1. Working table comprising:

working surface;

first and second front support elements and first and second rear support elements for supporting said working surface;

each of said rear support elements comprising a hollow section having a tubular central part with an outer periphery, coupling channels formed on said tubular central part and distributed around said outer periphery, and with at least two coupling flanges which extend along at least a part of said hollow section, said coupling flanges subtending an angle to one another;

coupling elements secured to said working surface at a position corresponding to said first and second rear support elements and being complementary in shape to said coupling flanges;

means for connecting said coupling elements to said coupling flanges in form and force-locked manner;

said coupling channels being orientated in two planes which extend perpendicular to one another and provided with respective projections; and first, second and third cover sections comprising a first planar cover section plate fixable between said coupling flanges, and first and second angled cover sections being fixable in each case between a said coupling flange and a said projection of a said coupling channel, said cover sections together with said hollow section forming a closed hollow section having a cross-section in the form of a right triangle.

2. Working table in accordance with claim 1 wherein said cover sections cooperate with a part of said outer periphery of said central part to form said closed hollow section having a cross-section in the form of a right triangle.

3. Working table in accordance with claim 1 including further projections on said coupling flanges for the mounting of said second and third cover sections.

4. Working table in accordance with claim 1 further comprising spaces formed between said central part and said cover sections forming cable guiding channels.

5. Working table in accordance with claim 1 wherein said closed hollow section having a cross-section in the form of a right triangle has two sides disposed at right angles to each other;

wherein said coupling flanges extend parallel to said two sides; and wherein a plane abutment surface is formed between said coupling flanges at said outer periphery of said central part.

6. Working table in accordance with claim 1 wherein said coupling elements each include an angled section arranged perpendicular to said working surface and secured to the latter, each said angled section having first and second mounting limbs, several mounting holes arranged above one another in said first and second mounting limbs, first and second rows of openings being provided in said coupling flanges and said mounting holes having a spacing corresponding to that of said openings in said coupling flanges.

7. Working table in accordance with claim 1 wherein said front support elements are disposed at a front region of said working surface and are inwardly displaced from said regions of said working surface thereby providing side regions, and including a container accommodated in at least one of said side regions; and rod means between said front support elements and a rear region of said working surface.

8. Working table in accordance with claim 7 wherein said front support elements comprise telescopically adjustable support elements.

9. Working table in accordance with claim 1 wherein said hollow sections extend upwardly beyond said working surface to a projecting region, said hollow sections and said coupling flanges forming mountings in said projecting region, said mountings including additional coupling members.

10. Working table in accordance with claim 1 further comprising a plug and bearing mount for closing said hollow sections.

11. Working table in accordance with claim 10 wherein said plug and bearing mount are pivotable.

12. Working table in accordance with claim 10 wherein said plug and bearing mount forms a flush cover part.

13. Working table in accordance with claim 1 wherein said tubular central part forms a conduit for one of vacuum and pressurized air.

14. Working table in accordance with claims 1 wherein said coupling elements are secured to said working surface.

15. Working table comprising:

a working surface;

first and second front support elements and fist and second rear support elements for supporting said working surface;

each of said rear support elements comprising a hollow section having a tubular central part with an outer periphery, coupling channels formed on said tubular central part and distributed around said outer periphery, said coupling channels provided with respective projections, and at least two coupling flanges which extend along at least a part of said hollow section, said coupling flanges subtending an angle to one another;

coupling elements secured to said working surface at a position corresponding to said first and second rear support elements and being complementary in shape to said coupling flanges;

means for connecting said coupling elements to said coupling flanges in a form and force-locked manner;

first, second and third cover sections comprising a first planar cover section plate fixable between said coupling flanges, and first and second angled cover sections being fixable in each case between a said coupling flange and a said projection of a said coupling channel, said cover sections together with said hollow section forming a closed hollow section having a cross-section in the form of a triangle.

* * * * *